United States Patent [19]

Glenn

[11] Patent Number: 4,553,005

[45] Date of Patent: Nov. 12, 1985

[54] TRIGGER OPERATED ELECTRIC SWITCH

[75] Inventor: Robert L. Glenn, Arab, Ala.

[73] Assignee: Eaton Corporation, Cleveland, Ohio

[21] Appl. No.: 587,728

[22] Filed: Mar. 8, 1984

[51] Int. Cl.[4] ..... H01H 13/08; H01H 9/06

[52] U.S. Cl. ..... 200/153 LA; 200/157; 200/6 B; 200/68.3

[58] Field of Search ..... 200/157, 153 LA, 239, 200/241, 242, 293, 307, 303, 6 B, 6 BA, 153 L, 68.1–68.3; 338/159, 160, 176

[56] References Cited

U.S. PATENT DOCUMENTS

| | | | |
|---|---|---|---|
| Re. 26,781 | 12/1965 | Frenzel | 200/157 |
| 2,886,340 | 5/1959 | Bittel | 200/293 |
| 3,354,731 | 2/1966 | Kussmaul | 74/55 |
| 3,381,104 | 4/1968 | Abell et al. | 200/157 |
| 3,484,632 | 12/1969 | Opalenik et al. | 200/157 X |
| 3,594,523 | 7/1971 | Frenzel | 200/157 |
| 3,755,640 | 8/1973 | Kaman et al. | 200/157 |
| 3,777,092 | 12/1973 | Yeske | 200/337 |
| 3,814,886 | 6/1974 | Piber | 200/157 |
| 4,097,704 | 6/1978 | Piber | 200/157 |
| 4,100,383 | 7/1978 | Piber | 200/157 |
| 4,118,614 | 10/1978 | Leibundgut | 200/157 |
| 4,118,615 | 10/1978 | Leibundgut | 200/157 |
| 4,137,490 | 1/1979 | Brozoski et al. | 200/157 X |
| 4,179,644 | 12/1979 | Vassos | 318/17 |
| 4,241,297 | 12/1980 | Piber et al. | 200/157 X |
| 4,241,298 | 12/1980 | Trammell, Jr. et al. | 200/157 X |
| 4,276,461 | 6/1981 | Piber | 200/329 |
| 4,286,125 | 8/1981 | Schaffeler et al. | 200/157 X |
| 4,329,555 | 5/1982 | Wied | 200/157 |
| 4,379,214 | 4/1983 | Matthews | 200/157 |

FOREIGN PATENT DOCUMENTS

| | | | |
|---|---|---|---|
| 48124 | 3/1982 | European Pat. Off. | 157/ |

*Primary Examiner*—Stephen Marcus

*Assistant Examiner*—Ernest G. Cusick

*Attorney, Agent, or Firm*—C. H. Grace; L. G. Vande Zande

[57] ABSTRACT

Variations of individual components are selectively assembled to satisfy specified switch characteristics and functions. A self-contained switching unit (2) comprises an actuator (8) mounted for linear reciprocal movement in a first housing (4) and having an end projecting through an end wall of the first housing, a return spring (52) biasing the actuator (8) to an extending position, and contactors (46, 48; 76, 78) positioned in pockets (**8*a*, 8*b*) in the actuator (8) above and below the return spring (52) to be cammed in opposite lateral directions upon depression of the actuator (8) to bridge large-mass stationary contacts (28, 30; 32, 34, 36) positioned firmly against sidewalls of the first housing (4). Camming arrangements carry the contactors (46, 48; 76, 78) into bridging engagement with the stationary contacts (28, 30; 32, 34, 36) and render contact pressure springs (86, 90) operative after such engagement. Selected versions of the actuator (8) and a trigger (12) to be attached to the projecting end of the actuator accommodate a variable depression adjustment screw (10, 14). The stationary contacts include integral terminal portions (28*a*, 30*a*; 32*a*, 34*a*, 36*a*) extending through a lower side (6) of the first housing (4) for plug-in connection with press-in (20) or pressure type (40) wiring terminals contained in a second housing (18) when the latter is attached to the first housing (4). Selected speed control circuit boards (26) may be positioned within the second housing (18) for plug-in connection with the stationary contact terminal portions (34*a*, 36*a*) upon attachment of the second housing (18) to the first housing (4). Variations in heat sinks (24) are accommodated within the second housing (18**).

29 Claims, 22 Drawing Figures

Fig. 7
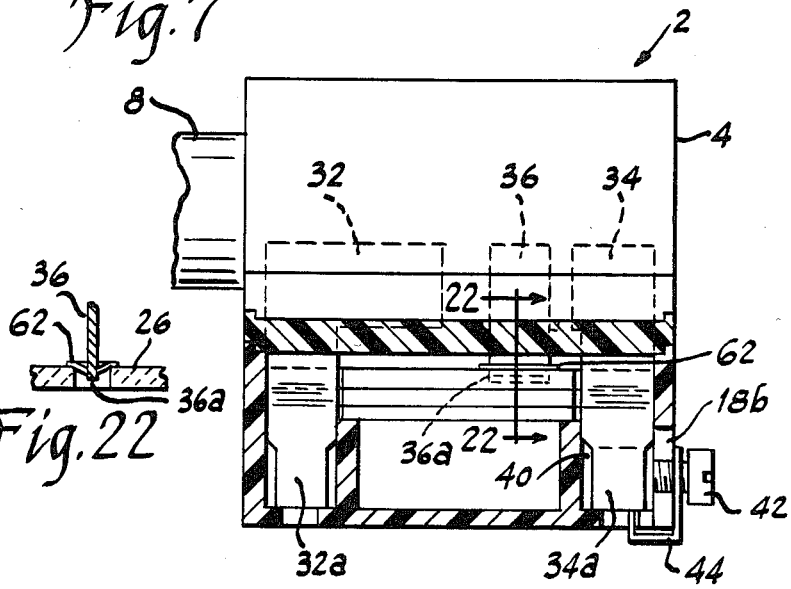
Fig. 22
Fig. 8
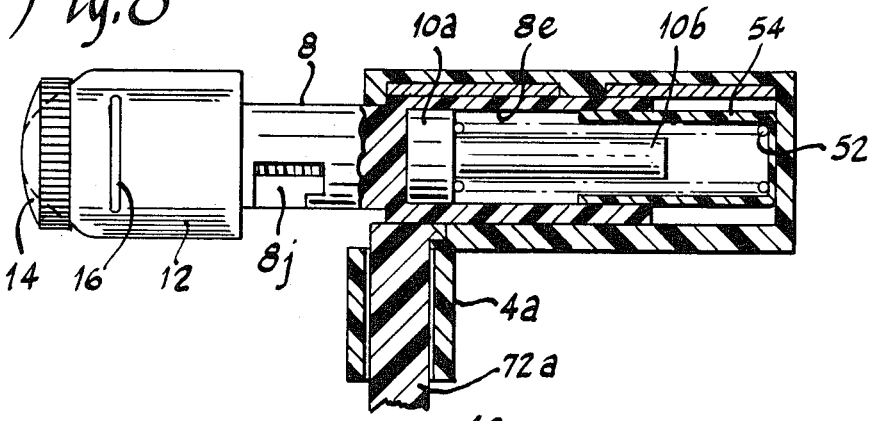
Fig. 9
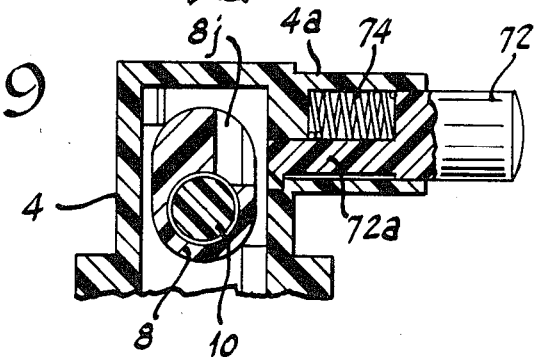

TRIGGER OPERATED ELECTRIC SWITCH

BACKGROUND OF THE INVENTION

This invention relates to electric switches of the trigger operated type which are particularly suited for controlling portable electric tools. More particularly, the invention relates to a trigger operated electric switch for portable electric tools which is adapted to be readily assembled into any one of several embodiments to meet various function and application requirements of the electric tool manufacturer.

It is necessary for electric switch manufacturers to produce a wide range of trigger operated electric switches to satisfy the diverse requirements of the variety of types of portable electric tools in which such switches are used, e.g., portable saws, impact devices, paint sprayers and drills. The control functions for such tools may specify a switch providing simple ON/OFF operation, discrete multiple speeds, or continuously variable speed. Still other functions such as a capability for locking the switch in the ON position and for setting a variable speed device to selected discrete speeds are also required in some applications. Moreover, the shape and color of the trigger operator are optional requirements for different devices. The external size and configuration of the trigger switch housing are required to conform to specifications to enable the interior of the tool housing to be structured to receive and position the switch within the housing without specific mounting or clamping hardware, and even these requirements vary appreciably between U.S. and foreign tool manufacturers. Electrical spacing requirements for current carrying parts and specific termination types for European used switches differ from those for switches utilized in the United States. Thus, to provide a line of switches having all of the aforementioned variables in different combinations, a switch manufacturer is faced with having a large inventory of individual switch designs and parts.

SUMMARY OF THE INVENTION

The trigger operated electric switch of this invention has individual parts particularly cooperably structured to enable a wide variety of combinations of functions to be provided by selective assembly of the respective parts. The switch operating mechanism and contact structure are arranged to provide the necessary electrical clearance required in the most extreme specifications, and at the same time to provide a compact, fully enclosed switching unit within a first housing structure by arranging the movable contactors along lateral edges of a contact actuator and causing the contactors to be cammed outwardly in opposite directions for closure upon laterally disposed stationary contacts. The latter fit firmly against exterior walls of the switch housing for increased heat dissipation. Alternative contactor arrangements are disclosed which render contact pressure springs effective only upon actual closure of the contactor upon the stationary contacts, thereby not to diminish the spring pressure by first requiring the spring to move the contactor to the closing position. The actuator extends from the switching unit and is configured at its projecting end to receive a trigger operator thereon, preferably with a snap-fit. The actuator and selected triggers have provisions for receiving a variable depth adjustment assembly for controlling the depth of depression of the trigger and actuator with respect to the switch housing for providing discrete speed positions for a variable speed device. A lower housing unit is adapted to be snap-fit attached to the switch housing. In its most basic form, the lower housing unit contains and provides wiring terminals for the switching unit. Contact terminals depending from the switching unit electrically engage the wiring terminals of the lower housing unit upon attachment of the lower housing unit to the switching unit. Variations in the wiring terminations are provided as well as modifications to the lower housing unit to enable the terminations to be of the press-in or screw operated pressure clamping type. The lower housing unit also has provision for receiving a speed control circuit board therein when such function is required, and may also accommodate a heat sink for the speed control circuit with space being provided for variations to increase the size of the heat sink as the power requirements of the particular switch are increased. The switch housing and the lower housing may be provided in varying external configurations to accommodate the mounting requirements of the tool manufacturers. The invention and its advantages will become more apparent from the following description and claims when read in conjunction with the accompanying drawings.

BRIEF DESCRIPTION OF THE DRAWINGS

FIG. 7 is a longitudinal cross sectional view taken along line 7—7 in FIG. 3 showing contact terminals of an upper switch unit and their relationship to wiring terminals in the lower switch unit;

FIG. 8 is a top plan view of the switch partly in section as indicated by the line 8—8 in FIG. 1 showing a locking feature of the switch;

FIG. 9 is a transverse cross sectional view taken along the line 9—9 of FIG. 1 also showing the locking feature of FIG. 8;

FIG. 22 is a fragmentary sectional view taken along the line 22—22 in FIG. 7.

DESCRIPTION OF THE PREFERRED EMBODIMENTS

Figure 1:
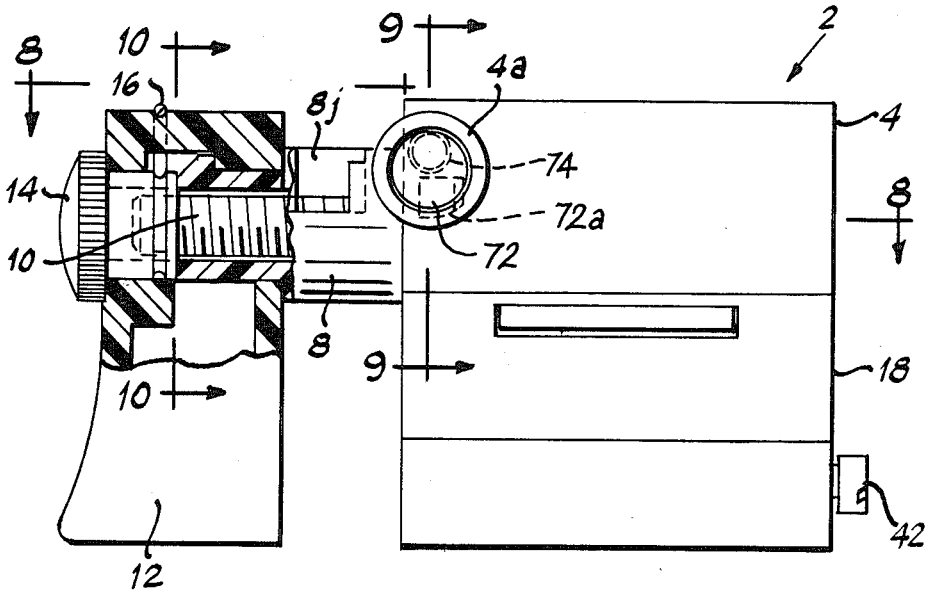
FIG. 1 is a side elevational view, partly in section, of a trigger operated electric switch of this invention.
Figure 2:
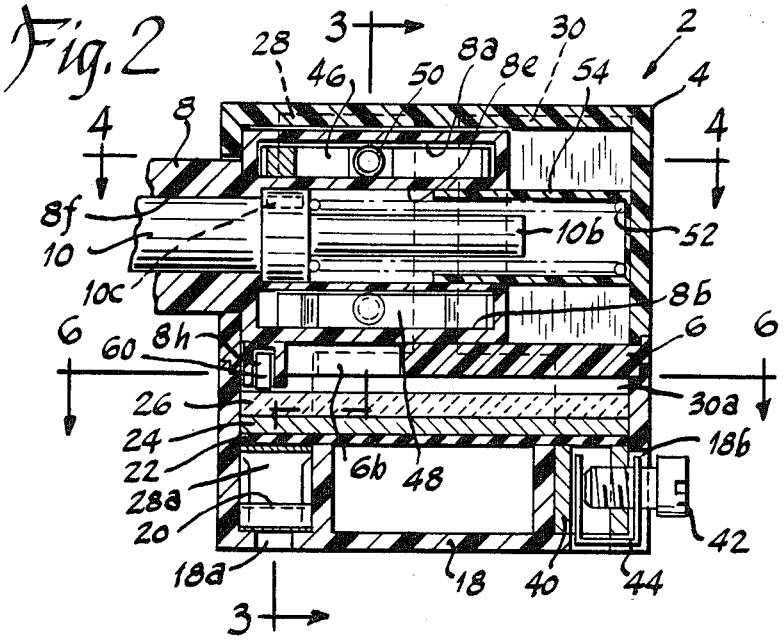
FIG. 2 is a longitudinal cross sectional view of the trigger operated electric switch of FIG. 1 taken along the line 2—2 shown in FIG. 3.
Figure 3:
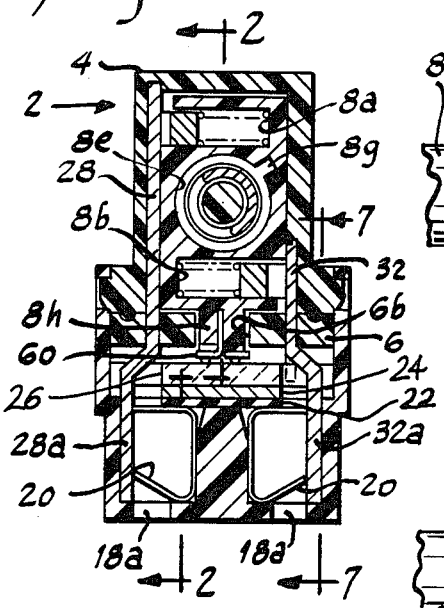
FIG. 3 is a transverse cross sectional view of the electric switch of this invention taken along the line 3—3 in FIG. 2.
Figure 12:
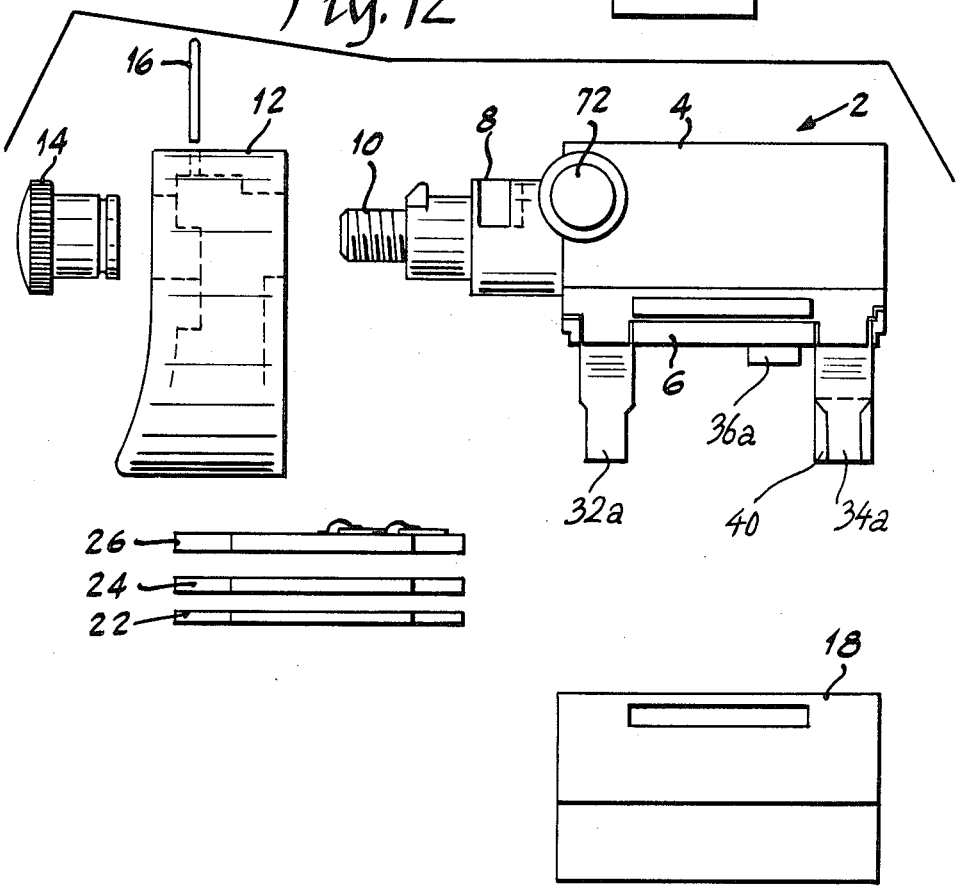
FIG. 12 is an exploded side elevational view of the switch.

Referring to FIGS. 1 and 12 of the drawings, the trigger operated electric switch of this invention comprises a switch unit 2 having an insulating main housing 4 which is open at the bottom and an insulating cover 6 which is assembled to the open bottom of the housing 4. An actuator 8 extends out one end of the housing 4 and, when specified, a variable depth shaft 10 is axially received within the actuator 8 and has a threaded end projecting beyond the end of actuator 8. A trigger member 12 is adapted to be snap-fit attached over the projecting end of the actuator 8. For those versions of the switch 2 which incorporate the variable depth shaft 10, trigger 12 is provided with a suitable opening in the front surface thereof for receiving the barrel portion of an adjusting knob 14 which has an internal threaded recess for engaging the projecting end of shaft 10. A U-shaped wire clip 16 is inserted from the top of trigger 12 to extend alongside the barrel portion of the knob 14 and engage in an annular groove in the barrel portion to secure the knob 14 against axial movement within the trigger 12, while permitting rotational movement thereof.. Stationary contacts of the main switch unit 2, which will be described hereinafter, have terminal portions 28*a*, 30*a*, 32*a*, 34*a* and 36*a* which depend from the main switch unit through corresponding openings in cover 6. A lower housing unit 18, also molded of electrical insulating material, is adapted to be snap-fit attached to the lower portion of housing 4. As seen in FIGS. 2 and 3, housing 18 may contain resilient C-shaped clips 20 received within pockets of the housing 18 adjacent the depending terminals such as 28*a* and 32*a* to form press in wiring terminals. In a well known manner, wire leads from the tool motor or from an electrical supply may be inserted through openings 18*a* in the bottom of lower housing 18 to deflect the lower legs of spring clips 20 so as to wedge the wire firmly between the clip 20 and the respective switch contact terminal. An insulator 22 is disposed in housing 18 over the upper ends of the spring clips 20 to rest upon the upper surface of vertical walls forming the spring clip pockets within the housing 18. When a speed control function is specified, a metal heat sink 24 and a speed control circuit board 26 are also inserted within the housing 18 in stacked relationship upon the insulator 22. Housings 4 and 18 may be provided with variations in external configuration to accommodate specific switch mounting requirements of different tool manufacturers. Trigger 12 and knob 14 may also be provided in different shapes and colors to accommodate the requirements of different tool manufacturers.

Figure 21:
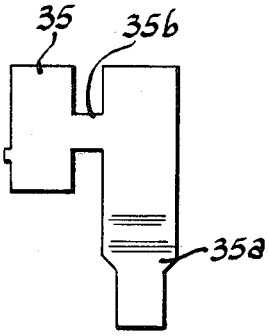
FIG. 21 is a view of an alternative contact terminal for use in an ON/OFF version of the switch.

Referring additionally to FIGS. 2–5, the housing 4 of switch unit 2 is essentially a hollow rectangular box. Housing 4 contains a first pair of stationary cntacts 28 and 30 mounted flush against the internal surface of one of the lateral sidwalls of housing 4 as may be best seen for contact 28 in FIG. 3. The contacts 28 and 30 are formed to have a relatively large rectangular shape within the housing 4 as seen by the dotted outlines thereof in FIG. 2. The upper wall of housing 4 is recessed to receive the upper ends of the contacts 28 and 30 for positioning the same tightly against the lateral sidewall, while the lower ends of these contacts are positioned by respective openings in lower cover 6. The large mass of contacts 28 and 30 and the location thereof firmly against the lateral sidewall of housing 4 provides good heat transfer between these elements and enhances the heat dissipation of the switch in operation. The lower ends of the rectangular portions of contacts 28 and 30 seat within grooves formed in the lower cover 6, the grooves not being specifically shown but which are in alignment with the openings in the cover 6 through which narrowed terminal portions 28*a* and 30*a* extend to be received within the respective pockets of lower housing member 18 for cooperation with clips 20. A second set of stationary contacts 32, 34 and 36 are mounted firmly against the internal surface of the opposite lateral sidewall of housing 4 as seen in FIGS. 3 and 7. Contacts 32, 34 and 36 are shorter than contacts 28 and 30, and, therefore, do not extend along the full height of the respective sidewall of housing 4. Referring specifically to FIG. 3, it can be seen that the upper ends of these contacts are provided with an upstanding tongue which is received within a complementally formed groove in a recess in the internal surface of the housing sidewall to lock the upper ends of these stationary contacts firmly in place against the sidewall. The lower ends of contacts 32, 34 and 36 have horizontally extending tabs and projections which are received within grooves formed in lower cover 6 similarly to those previously described for contacts 28 and 30 and are also positioned by depending terminal portions 32*a*, 34*a* and 36*a* which extend through respective openings in cover 6 to be received within the respective pockets of lower housing 18 in cooperative relationship with terminal clips 20. In switches of the ON/OFF type in which speed control is not required, the contacts 34 and 36 may be formed as a single contact such as 35 shown in FIG. 21. It will be appreciated that the outline of contact 35 is identical to the combined outline of contacts 34 and 36 joined by a web of material 35*b*. For switches requiring pressure type terminal connectors, particularly for the power supply terminals 30 and 34 or 35, screw type lug connectors 40 may be attached to the lower ends 30*a* and 34*a* or 35*a* such as by welding or the like. As best seen in FIG. 2, the lugs 40 are provided with a hole extending upwardly therethrough for receiving a conductor wire and with a threaded hole intersecting the wire receiving hole at a right angle for receiving a clamping screw 42. The clamping screw may be provided with a U-shaped clip 44 retained on the screw and which extends around the lower endwall of the lug 40 to project into the wire receiving opening adjacent the end of the clamping screw 42 to provide an intermediate protective surface between the wire and the end of clamping screw 42. When pressure terminals are required, the lower housing 18 is modified to provide openings 18*b* in the sidewalls to accommodate the screw 42 and clip 44.

Figure 4:
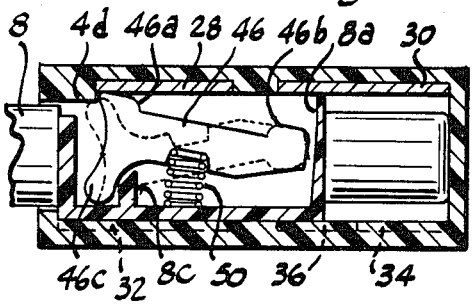
FIG. 4 is a horizontally transverse cross sectional view taken along the line 4—4 of FIG. 2 showing the contacts and operating mechanism of the switch in a switch OFF position.
Figure 5:
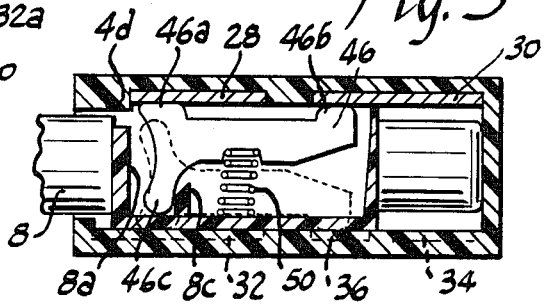
FIG. 5 is a horizontal transverse cross sectional view similar to FIG. 4 but showing the switch contacts and operating mechanism actuated to a switch ON position.

The body of actuator 8 which is disposed within the housing 4 is essentially rectangular in cross sectional and longitudinal shape to closely conform to the interior shape of housing 4. The body of actuator 8 is provided with a pair of rectangular recesses or pockets 8*a* and 8*b* located in the upper and lower portions of the actuator body respectively. The upper recess 8*a* is open along the lateral edge adjacent stationary contacts 28 and 30, while the lower recess 8*b* is open along the opposite lateral edge adjacent stationary contacts 32–36. Each pocket 8*a* and 8*b* contains a bridging contactor 46 and 48, respectively. The contactors 46 and 48 are identical and only the upper contactor 46 will be described in detail although the outline of the lower contactor 48 is shown in dotted lines in FIGS. 4 and 5. As seen in FIGS. 4 and 5, the contactor 46 has a pair of contact making surfaces 46*a* and 46*b* at its opposite ends. A heel 46*c* is formed on the end of contactor 46 adjacent the contact surface 46*a* and projects away from the contact surface at approximately right angles thereto. The heel 46*c* is received within a smaller pocket formed within the recess 8*a* by a stub wall 8*c* within that recess. A helical compression spring 58 bears between the rear wall of recess 8*a* and the contactor 46 to bias that contactor laterally outwardly of the recess toward engagement with the respective stationary contacts 28 and 30. The interior of housing 4 is provided with a protrusion 4*d* adjacent the left-hand end as viewed in FIGS. 4 and 5 against which the end of contact surface 46*a* abuts when the actuator 8 is biased to its outermost extended position by a helical spring 52 (FIGS. 2 and 8). This abutment occurs just prior to the full extension of actuator 8, and full extension of actuator 8 causes the stub wall 8*c* to engage heel 46*c* of the contactor 46 to pivot the contactor 46 clockwise as viewed in FIG. 4 against the bias of spring 50, thereby pulling the contact surface 46*b* away from engagement with stationary contact 30 in the extended position of actuator 8. Depression of actuator 8 against the bias of return spring 52 carries contactor 46 to the right as viewed in FIGS. 4 and 5 by virtue of the engagement of the left-hand end of recess 8*a* with the heel 46*c* of the contactor thereby enabling the contactor to pivot counterclockwise under the bias of spring 50 as the heel portion moves beyond the point of engagement of contact surface 46*a* with protrusion 4*d*. As seen in FIG. 5, contactor surfaces 46*a* and 46*b* are then in bridging engagement with stationary contacts 28 and 30. Continued depression of the actuator 8 to the right causes the contactor 46 to slide along the surfaces of stationary contacts 28 and 30 with a contact cleaning wiping action. The reverse operation occurs with respect to contactor 48 contained in the lower pocket 8*b* wherein the contact surface corresponding to surface 46*b* of contactor 46 is brought into engagement with stationary contact 36 or the corresponding portion of contact 35. Continued movement of actuator 8 to the right causes that contact surface to wipe along the web portion 35*b* of stationary contact 35 when it is used, or to slide off of stationary contact 36 and to engage stationary contact 34 when these separate contacts are utilized in the switch.

Actuator 8 has a longitudinally extending cylindrical opeing 8*e* in the body portion thereof between the pockets 8*a* and 8*b* and open to the right-hand end of the actuator within the switch housing 4. A smaller cylindrical opening 8*f* is provided in the outwardly extending left-hand end of the actuator 8 which communicates coaxially with the opening 8*e* to provide an annular shoulder at the junction of the two cylindrical openings 8*e* and 8*f*. The latter opening is required only for versions of The switch requiring a variable depth depression adjustment feature for the actuator. However, to reduce the number of distinct parts, each actuator may contain the opening 8*f*. A cylindrical insulating tube 54 has its open end telescopically disposed within the cylindrical recess 8*e* of actuator 8, and has its closed end seating flush against the interior end surface of housing 4. Spring 52 is received within the tube 54, one end of which bears against the closed end of the tube 54 and the other end of which biases the actuator to its extended position. For versions of the switch incorporating the aforementioned variable depth depression adjustment, the left end of spring 52 bears upon an enlarged disk portion 10*a* of shaft 10 to bias disk portion 10*a* against the shoulder formed by openings 8*e* and 8*f*. Where such adjustment feature is not required, a separate disk (not shown) may be inserted within the opening 8*e* to receive the left end of spring 52, thereby to bias the actuator to its extended position. The left-hand end of shaft 10 is threaded and extends through the opening 8*f* of actuator 8 to expose the threaded end within the trigger 12 for engagement with the internally threaded opening of knob 14 as described earlier. The right-hand end of shaft 10 has a reduced diameter portion 10*b* extending to the right within the spring 52 and tube 54. As seen in FIG. 3, the main body of actuator 8 also is provided with a straight keyway 8*g* which communicates with the cylindrical opening 8*e* along its length and in which a key 10*c* (shown in dotted lines in FIG. 2) is disposed to provide axial non-rotational movement of shaft 10 with respect to the actuator 8. Rotation of the knob 14 thereby threads the shaft 10 to the left or right to vary the distance which the end of projection 10*b* extends beyond the right-hand end of actuator body 8, thereby to change the amount of depression of actuator 8 permissible before the end of shaft portion 10*b* engages the endwall of tube 54.

Figure 6:
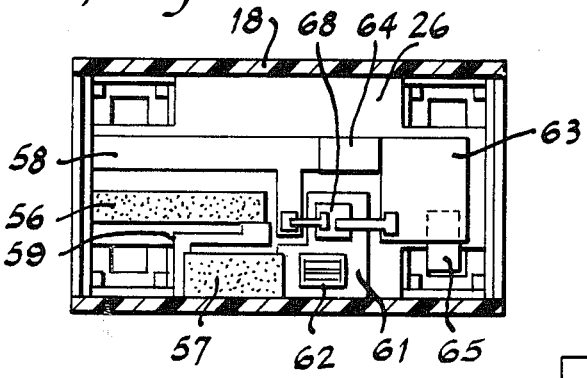
FIG. 6 is a horizontal transverse cross sectional view taken along the line 6—6 in FIG. 2 showing a circuit board positioned within a lower housing unit of the switch.

For switches requiring speed control of the electric tool motor as a function of the depth of depression of the trigger and actuator, the speed control circuit board 26 is inserted within the lower housing 18 as aforedescribed. The upper surface of the speed control circuit board 26 is provided with various components of the speed control circuit printed and/or mounted thereon including a resistor strip 56 and a metallized collector strip 58 as seen particularly in FIG. 6. The lower surface of actuator 8 is provided with a depending boss 8*h* (FIG. 2) which projects through an opening 6*b* in cover 6 to extend into the lower housing 18. The boss 8*h* has a narrow central slot into which is inserted a Y-shaped wiper contact 60 made of good spring contact material. As seen in FIG. 3, the wiper 60 has oppositely directed contacts, one for engaging the surface of resistor 56 and the other for engaging the surface of collector 58. As the actuator 8 is moved to the right by depression of the trigger, the wiping contact 60 moves along the resistor 56 and collector 58 to decrease the resistance in the circuit, thereby affording control of the speed control circuit through trigger movement. As seen in FIG. 6, the right-hand end of resistor 56 is connected to the left-hand end of a screened trim resistor 57 by a screened conductor 59 and the right-hand end of resistor 57 is connected to a large screened conductive pad 61. A connector clip 62 is mounted on the conductive pad 61 over an aperture in the substrate. As seen in FIG. 22, clip 62 has opposed resilient fingers which engage with stationary contact terminal 36*a* when the lower housing is attached to the switch unit housing. Pad 61 also serves to mount the anode of a silicon controlled rectifier 68. The gate of rectifier 68 is connected to conductor 58. The right-hand end of conductor 58 is joined by means of a capacitor 64 to a copper heat sink 63 mounted on the surface of printed circuit board 26. The cathode of rectifier 68 is connected to heat sink 63. A resilient tab contact 65 mounted between heat sink 63 and the surface of printed circuit board 26 projects beyond the edge of board 26 over the pocket of housing 18 which receives stationary contact terminal 34*a* to be deflected by that terminal upon attachment of lower unit 18 to switching unit housing 4, thereby to form a second electrical connection between the speed control circuit and the switching unit contacts.

Figure 11:
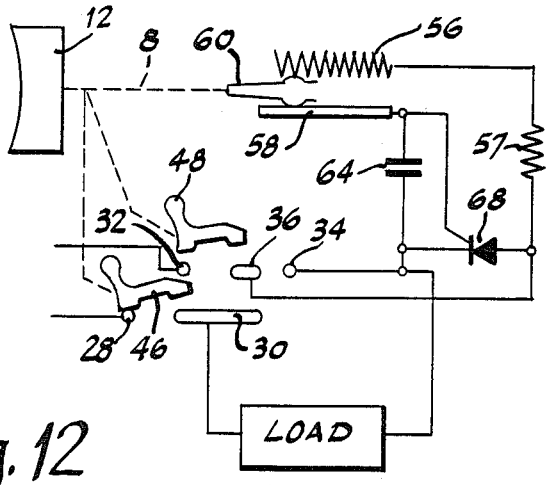
FIG. 11 is a schematic view showing the contact operating sequence and speed control circuit for the switch.

With reference to the schematic diagram in FIG. 11, it can be seen that initial movement of the trigger 12 causes the contactor 46 to bridge the stationary contacts 28 and 30 and the contactor 48 to bridge the stationary contacts 32 and speed control contact 36 thereby connecting the tool motor to a power source through the speed control circuit. The RC timing circuit provided by resistor 56, conductor 58 and capacitor 64 establishes an initial firing control angle for silicon controlled rectifier 68. As the resistance is decreased by depression of trigger 12, thr firing control angle for silicon controlled rectifier 68 increases whereby increasing amounts of halfwave voltage are applied to the motor to increase the speed thereof in a manner that is known in the art. Reference may be had to H. W. Brown, U.S. Pat. No. 3,775,576 for a further understanding of the operation of the speed control circuit. As also described in that patent, full depression of the trigger to the right causes the contactor 48 to bridge the contacts 32 and 34 in the full ON position of the switch, thereby connecting the motor directly across the input power in shunt of the speed control circuit.

Figure 20:
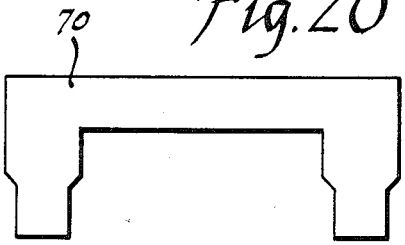
FIG. 20 is a view of a contact jumper element which may be selectively incorporated into the lower housing unit.
Figure 10:
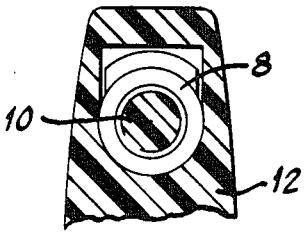
FIG. 10 is a partial cross sectional view taken along the line 10—10 of FIG. 1 showing cooperating structural relationships for attaching the trigger to the actuating shaft of the switch.

A shunting strap 70 is shown in FIG. 20 This strap may be inserted within the lower housing 18 adjacent the terminals 28*a* and 30*a* for applications of the switch wherein a double break circuit is not required, and provides an internal jumper between the incoming power terminal 30 at the rear of the switch and the motor terminal 28 at the front of the switch thereby obviating the need for an external hard-wired connection for such applications.

A locking mechanism for retaining the actuator 8 in the depressed condition is shown in FIGS. 1, 8 and 9. Housing 4 is provided with a cylindrical boss 4*a* which has a lower half semi-cylindrical opening into the interior of the housing. A locking button 72 is disposed within cylindrical boss 4*a* and has an offset leg 72*a* extending through the semi-cylindrical opening to the interior of housing 4. The innermost end of leg 72*a* is provided with a flange portion along right and lower edges as seen in the drawings to engage the interior surface of housing 4 to limit outward movement of the button. A sprong 74 is disposed between the button and the housing 4 within the internal recess of cylindrical boss 4*a* to bias the button 72 to its outermost extended position. Actuator 8 is provided with a stepped recess 8*j* which becomes aligned with extension 72*a* when the actuator is fully depressed. When in this position, the button 72 may be depressed to cause the flange portion 72*b* to enter the recess 8*j*. Removal of finger pressure from actuator 8 and trigger 12 allows the spring 52 to bias the actuator outwardly and such movement is stopped by engagement of recess of 8*j* with the extension 72*a*. The flange 72*b* hooks upon a shouldered portion of the recess 8*j* to prevent the withdrawal of pin 72 by action of spring 74 until such time as the trigger 12 and actuator 8 are again moved slightly inwardly to enable the stepped portion of recess 8*j* to clear the flange 72*b*.

Figure 13:
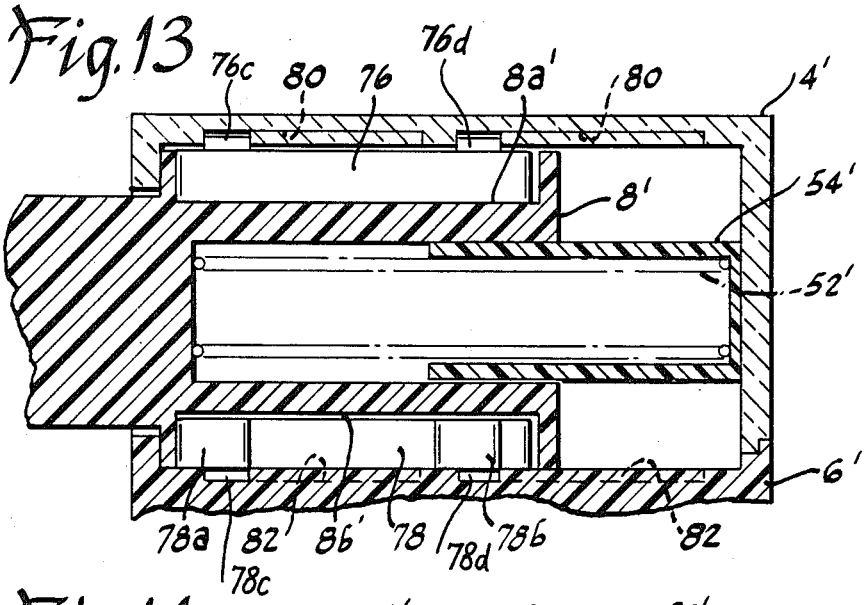
FIG. 13 is a longitudinal cross sectional view similar to the upper housing portion of FIG. 2, but showing an alternative contact structure and wherein the upper housing is depicted as a transparent part for the sake of illustration in FIGS. 14–19.
Figure 14:
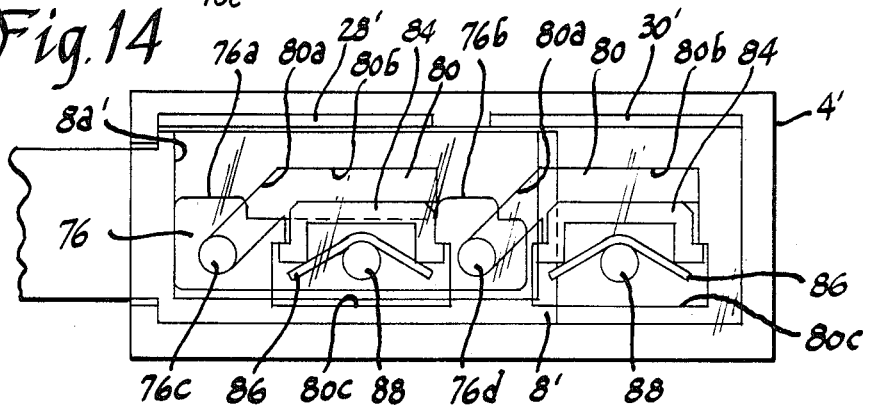
FIG. 14 is a top plan view of the switch shown in FIG. 13 showing the alternative contact structure in a switch OFF position.
Figure 15:
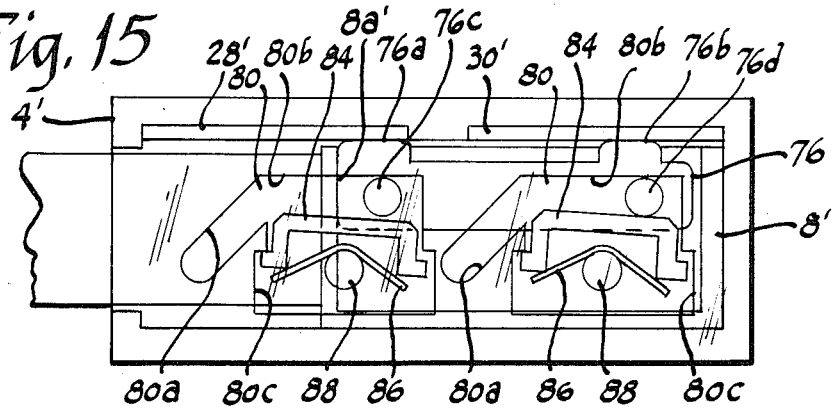
FIG. 15 is a view similar to FIG. 14 but showing the contact structure in a switch ON position.

An alternate contactor embodiment for the switch of this invention is disclosed in FIGS. 13–15. FIG. 13 is a cross sectional view similar to the upper half of FIG. 2. The reference characters from the aforedescribed embodiment have been carried through for similar elements in FIGS. 13–15, but have been given a prime postscript. Referring to FIG. 13, an actuator 8' has upper and lower pockets 8*a'* and 8*b'* which are formed to be open to the upper and lower surfaces, respectively, as well as to the respective lateral sides of the switch. Contactors 76 and 78 are provided in upper and lower pockets 8*a'* and 8*b'*, respectively. Contactors 76 and 78 are identical and only contactor 76 will be described herein. For purposes of illustration only, housing 4' is indicated as being transparent. As seen in FIG. 14, contactor 76 has a pair of contact surfaces 76*a* and 76*b* formed at its opposite ends. Also provided at the opposite ends of contactor 76 are upstanding cylindrical bosses 76*c* and 76*d*. The interior surface of the upper wall of housing 4' is provided with a pair of dog-leg recesses 80 comprising angular portions 80*a* which join with longitudinal portions 80*b* extending to the right in the direction of movement of actuator 8' when depressed. Similar recesses 82 are formed in the upper surface of cover 6', the recesses 82 being angularly disposed toward the opposite lateral sidewall as are recesses 80. One edge of the longitudinal portions 80*b* of recesses 80 opens to a larger recess 80*c* which has shouldered surfaces at its opposite ends. A pair of U-shaped insulating pressure members 84 are disposed within recesses 80*c* and are biased into the portion 80*b* by springs 86 which are disposed around cylindrical projections 88 molded integrally in the upper surface of housing 4' within the recesses 80*c*. Similar recesses, pressure members and springs are provided in cover 6' associated with recesses 82. Depression of actuator 8' to the right carries contactors 76 and 78 to the right within the recesses 8*a'* and 8*b'*, thereby causing the bosses 76*c* and 76*d* to translate angularly rightward and upward as viewed in FIG. 14 within the angular portions 80*a* of recesses 80. This movement carries the contactor surfaces 76*a* and 76*b* laterally into engagement with the stationary contacts 28' and 30'. Continued movement of actuator 8' to the right carries the bosses 76*c* and 76*d* into the longitudinally extending portions 80*b* of the recesses 80 and into engagement with the facing bight portion of each of the U-shaped pressure members 84. The engagement of contact surfaces 76*a* and 76*b* with the stationary contacts 28' and 30', respectively, causes the bosses 76*c* and 76*d* to deflect the pressure members 84 against the bias of springs 86 thereby providing contact pressure for the engagement between contactor 76 and the respective stationary contacts. This arrangement has a particular advantage in that contact pressure of springs 86 is applied only at such time as the contactor mates with the respective stationary contacts and does not require the contact pressure spring to effect the lateral movement of the contactor into engagement with the stationary contacts wherein the spring pressure would be diminished through the initial lateral movement of the contactor prior to closure on the stationary contacts.

Figure 16:
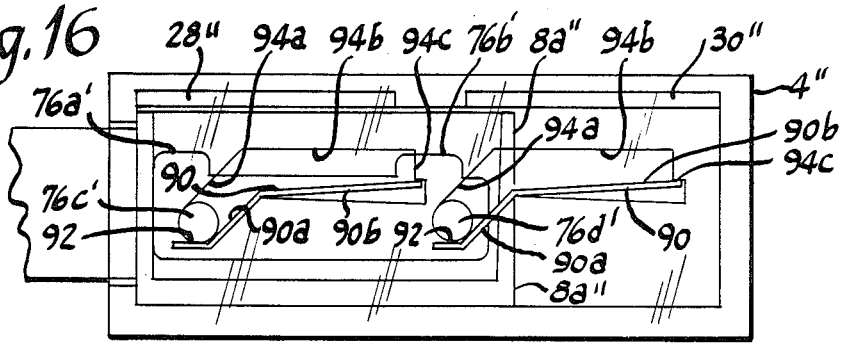
FIG. 16 is a view similar to FIG. 14 but showing a second alternative embodiment of contact structure in a switch OFF position.
Figure 17:
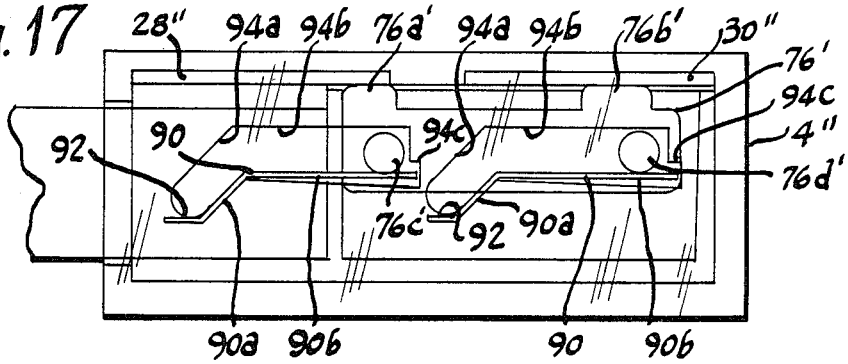
FIG. 17 is a view similar to FIG. 16 showing that contact structure in a switch ON position.

A variation of the contactor arrangement of FIGS. 13–15 is shown in FIGS. 16 and 17. In this embodiment the pressure members 84 and springs 88 are replaced by dog-leg springs 90 which are held in place by grooves 92 molded in the housing 4''. The angular legs 90*a* of the springs 90 lie within the angular portion 94*a* of dog-leg recesses 94 formed in housing 4''. The longitudinal portions 90*b* of springs 90 project into corresponding longitudinal portions 94*b* of recesses 94 and are performed to have a bias to extend angularly toward the stationary contacts 28'' and 30'', but are limited in this respect by engagement of the ends of portions 90*b* with shoulders 94*c* formed in the right-hand endwalls of the recesses 94. The inboard edges of longitudinal recess portions 94*b* are formed to be angularly divergent from the outboard edges of recess portions 94*b* to permit deflection of spring portion 90*b* by the bosses 76*c'* and 76*d'* of contactor 76' when the latter engage stationary contacts 28'' and 30'', thereby to provide contact pressure for the contactor 76'.

Figure 18:
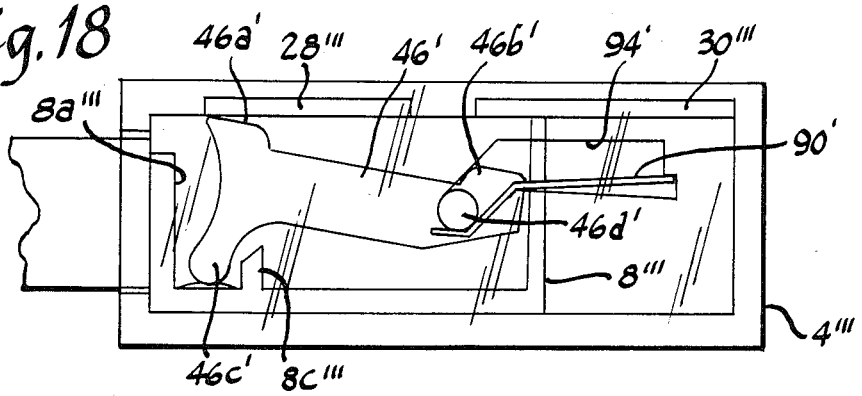
FIG. 18 is a view similar to FIG. 14 but showing a third alternative embodiment of contact structure in a switch OFF position.
Figure 19:
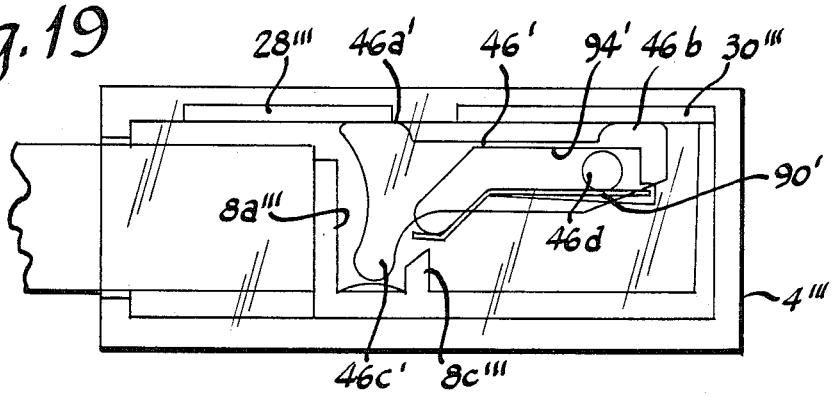
FIG. 19 is a view similar to FIG. 18 showing that contact mechanism in a switch ON position.

Still another embodiment is shown in FIGS. 18 and 19 wherein a contactor similar to contactor 46 of the first described embodiment is modified to be utilized in conjunction with a single slot such as slot 94 in FIGS. 16 and 17. In FIGS. 18 and 19 a contactor 46' has a cylindrical boss 46*d'* formed on the end thereof comprising contact surface 46*b'*. The interior surface of the upper wall of housing 4''' has a single recess 94' formed near the right-hand end identical to the right-hand recess 94 of FIGS. 16 and 17. The recess 94' is provided with a leaf spring 90' identical to spring 90. A dome shaped leaf spring 96 is inserted under the heel 46*c'* of contactor 46' with the pocket formed by stub wall 8*c'''* to bias the contact surface 46*a'* resiliently into engagement with the contact 28'''. In this version, the protrusion 4*d* is not required to provide the pivotal movement of the contactor. Instead, the right-hand end of contactor 46' is translated into and out of engagement with stationary contact 30''' by means of the camming action of recess 94' and contact pressure is applied by spring 90'. The compression spring 50 is also not required in this embodiment.

The foregoing has described a trigger operated electric switch wherein the individual components of the switch are particularly structured and arranged to enable any one of a variety of functional requirements to be incorporated by selective assembly of components. It also provides an improved contact mechanism wherein movable contacts are cammed in opposite lateral outward directions to abut stationary contacts mounted flush against lateral outer walls of the housing, thereby to provide a more compact switching unit and to improve heat dissipation for the switch. Alternative contact arrangements have contact pressure spring arrangements which become effective only upon contact closure, thereby eliminating any diminished spring pressure by requiring that spring element to be the moving force for bringing the contacts into engagement. While the invention has been described in various preferred embodiments, it is to be understood that it is susceptible of modifications without departing from the scope of the appended claims.

I claim:

1. A trigger operated electric switch comprising, in combination:

an insulating housing;

an actuator mounted for linear reciprocal movement in said housing and having a trigger operator extending outwardly of said housing;

means biasing said actuator to an extended position of said trigger with respect to said housing;

stationary contacts mounted against internal surfaces of opposite sidewalls of said housing, said stationary contacts being linearly spaced apart in the direction of said linear reciprocal movement of said actuator;

a pair of contactors carried by said actuator for linear movement therewith, said contactors being disposed at opposite sides of said actuator adjacent respective ones of said internal surfaces and being movable in opposite laterally outward directions with respect to said actuator; and means on said housing engagable with said contactors and responsive to depression of said trigger operator for moving said contactors laterally outward of said actuator in opposite directions into bridging engagement with said stationary contacts.

2. The invention defined in claim 1 wherein said contactors each comprise a pair of contact surfaces and said means for moving said contactors laterally outward of said actuator comprise individual means for each contact surface wherein each contact surface of a respective contactor is moved into and out of engagement with a respective one of said linearly spaced stationary contacts at a respective sidewall of said housing.

3. The invention defined in claim 2 wherein said means for moving said contactors laterally outward of said actuator comprises a pair of projections on each said contactor slidably received within a pair of recesses in said housing, said recesses being angularly disposed toward said stationary contacts with respect to the direction of movement of said actuator in response to depression of said trigger.

4. The invention defined in claim 3 wherein said recesses include portions parallel to said direction of movement of linear said actuator, said parallel portions being contiguous with said angularly disposed portions wherein said projections are received within said angularly disposed portions during movement of said actuator in response to initial trigger depression and said projections are received within said parallel portions during continued trigger depression.

5. The invention defined in claim 4 further including biasing means adjacent said parallel portions of said recesses for biasing said contactors against said stationary contacts when said projections are received within said parallel portions.

6. The invention defined in claim 5 wherein said biasing means comprises spring means disposed within said recesses and effective to bias said contactors only when said projections are in said parallel portions of said recesses.

7. The invention defined in claim 6 wherein movement of said contactors out of bridging engagement with said stationary contacts occurs on outward movement of said trigger by engagement of said projections within said angularly disposed positions, said springs being non-effective when said projections are in said angular portions.

8. The invention defined in claim 1 wherein said insulating housing comprises first and second housing sections, said first housing section comprising a housing member and a cover member enclosing said actuator, biasing means, contactors and stationary contacts, said stationary contacts having extensions projecting through corresponding openings in said first housing section, said second housing section having openings for receiving said stationary contact extensions, wiring terminal means within said openings cooperating with said extensions for effecting electrical connection of a wire to said stationary contact extensions, and means for attaching said second housing section to said first housing section for enclosing said stationary contact extensions.

9. The invention defined in claim 8 further comprising:

a speed control circuit contained in said second housing section for varying power supplied to a load device through said switch, said speed control circuit including a variable resistor and means electrically connecting said speed control circuit to a respective stationary contact;

an aperture in said first housing section communicating between said actuator and said variable resistor; and means connecting said actuator and said variable resistor through said aperture for varying the resistance in said speed control circuit as a function of trigger depression.

10. The invention defined in claim 9 wherein said speed control circuit comprises a heat sink contained within a cavity in said second housing section, and said second housing section has a second cavity adjacent said first mentioned cavity for accommodating structural variations of said heat sink.

11. The invention defined in claim 9 wherein said electrical connecting means comprises separable mating connector means engagable upon attachment of said first and second housing sections.

12. The invention defined in claim 11 wherein said speed control circuit comprises a printed circuit board positioned within a complemental opening in said second housing section and one part of said separable mating connector means is mounted on said printed circuit board.

13. The invention defined in claim 12 wherein said one part of said separable mating connector means comprises a flexible conductor mounted on said printed circuit board for engagement with an extension of a respective one of said stationary contacts.

14. The invention defined in claim 1 further comprising:

speed control means within said housing operable by said actuator for increasing power supplied to a load device through said switch in relation to increasing depression of said trigger; and means for selectively limiting the depth of which said trigger may be depressed comprising:

an opening extending longitudinally through said trigger operator and said actuator;

a pin disposed wthin said opening and keyed for non-rotational sliding movement within said actuator opening, said pin having a threaded end positioned within said trigger opening;

a knob rotatably journaled in said trigger opening and restrained from linear axial movement therein, said knob having a threaded axial bore receiving the threaded end of said pin; and said pin being driven axially within said actuator opening in response to rotation of said knob for causing an opposite end of said pin to extend a variable distance beyond said actuator for abutment with an interior surface of an endwall of said housing for limiting depression of said trigger.

15. The invention defined in claim 14 wherein said means biasing said actuator comprises a helical spring operating between said actuator and said interior surface of said housing endwall and said opposite end of said pin is disposed axially within said spring.

16. The invention defined in claim 15 wherein said actuator includes a cylindrical bore for receiving said spring therein.

17. The invention defined in claim 16 wherein said pin has a rearward facing annular shoulder intermediate said ends of said pin and said helical spring engages said annular shoulder and said interior surface of said housing endwall.

18. The invention defined in claim 14 wherein said trigger operator comprises a shaft projecting from said actuator externally of said housing and a "separate" finger-engagable trigger element affixed to an external end of said shaft, said longitudinal opening for said pin extending through said shaft and including a correspondingly aligned opening in said trigger element.

19. The invention defined in claim 18 wherein said trigger element is snap-fit attached to said shaft.

20. The invention defined in claim 1 wherein said biasing means comprises a helical spring disposed in a recess in said actuator, said recess extending longitudinally in the direction of said linear reciprocal movement of said actuator, and said contactors are laterally movable in offset planes parallel with the direction of linear movement of said actuator, said offset planes being disposed on opposite sides of said recess.

21. The invention defined in claim 20 wherein said contactors are disposed in at least partially over-lapping relationships in a plane perpendicular to said offset planes.

22. The invention defined in claim 1 wherein lateral movement of said contactors is in a horizontal plane parallel with the direction of linear movement of said actuator.

23. The invention defined in claim 1 wherein said contactors are disposed in offset planes parallel with the direction of linear movement of said actuator.

24. The invention defined in claim 1 wherein initial movement of said actuator when said trigger is depressed effects said lateral outward movement of said contactors into said bridging engagement with said stationary contacts and wherein further movement of said actuator carries said contactors linearly along said stationary contacts in sliding engagement therewith.

25. The invention defined in claim 1 wherein said means for moving said contactors laterally outward of said actuator comprises means projecting from said contactors slidably received in recesses in said housing, said recesses being angularly disposed toward said stationary contacts with respect to said linear direction of movement of said actuator in response to depression of said trigger.

26. The invention defined in claim 1 wherein said means for moving said contactors laterally outward of said actuator comprises a pair of projections on each said contactor slidably received within recesses for each said projection in said housing, said recesses being disposed angularly outward toward said stationary contacts with respect to the direction of movement of said actuator in response to depression of said trigger for moving each of said contactors into and out of respective bridging engagement with said linearly spaced stationary contacts.

27. The invention defined in claim 1 wherein said biasing means for said actuator comprises a recess in said actuator extending in the direction of movement of said actuator, and a spring biased plunger within said recess and projecting beyond the end of said actuator for abutment against an interior surface of a housing endwall, said plunger being formed complementally to said recess for axially guiding and positioning the free end of said plunger on said interior surface.

28. The invention defined in claim 1 wherein said stationary contacts comprise substantially flat portions mounted flush against internal surfaces of opposed lateral sidewalls of said housing in thermally conductive contact therewith.

29. The invention defined in claim 28 wherein said flat portions of stationary contacts mounted against said internal surface of at least one of said opposed lateral sidewalls of said housing are of large proportion so as to be in flush engagement with a majority of said internal surface of said housing sidewall.

* * * * *